United States Patent [19]

Waldhauser et al.

[11] Patent Number: 4,483,041

[45] Date of Patent: Nov. 20, 1984

[54] SUPPORT FOR A SQUEEGEE ASSEMBLY

[75] Inventors: Steven J. Waldhauser, Niagara Falls; Richard D. Masbruch, Ransomville, both of N.Y.

[73] Assignee: Wetrok, Inc., Niagara Falls, N.Y.

[21] Appl. No.: 431,051

[22] Filed: Sep. 30, 1982

[51] Int. Cl.[3] ..... A47L 7/00; A47L 11/30

[52] U.S. Cl. ..... 15/359; 15/98; 15/320

[58] Field of Search ..... 15/320, 353, 98, 359, 15/401

[56] References Cited

U.S. PATENT DOCUMENTS

| | | | |
|---|---|---|---|
| 2,930,055 | 12/1957 | Fallen et al. | 15/4 |
| 3,065,490 | 11/1962 | Arones | 15/359 |
| 3,277,511 | 10/1966 | Little et al. | 15/320 |
| 3,290,716 | 12/1966 | Cain | 15/353 |
| 3,345,671 | 10/1967 | Wilson et al. | 15/320 |
| 3,376,597 | 4/1968 | Boyd | 15/320 |
| 3,496,591 | 2/1970 | Scheler | 15/320 |
| 3,649,995 | 3/1972 | Ison | 15/320 |
| 3,722,025 | 3/1973 | Gledhill | 15/340 |
| 3,939,518 | 2/1976 | Whitney et al. | 15/98 |
| 4,006,506 | 2/1977 | Burgoon | 15/50 R |
| 4,037,289 | 7/1977 | Dojan | 15/320 |
| 4,173,056 | 11/1979 | Geyer | 15/320 |
| 4,339,841 | 7/1982 | Waldhauser et al. | 15/359 |
| 4,363,152 | 12/1982 | Karpanty | 15/320 X |
| 4,380,844 | 4/1983 | Waldhauser et al. | 15/320 |

OTHER PUBLICATIONS

"Floor scrubbing"-Clarke-Gravely Corporation, 432 scrubber-Tennant Company-Copyright 1980.

*Primary Examiner*—Philip R. Coe
*Assistant Examiner*—Frankie L. Stinson
*Attorney, Agent, or Firm*—Christel, Bean & Linihan

[57] ABSTRACT

An improved support (48) for mounting a crescent shaped squeegee assembly (46) on the body (18) of a self propelled walk behind floor scrubbing machine (10) of the type which deposits cleaning fluid on a hard surfaced floor, scrubs the floor, and then squeegees and vacuums the dirty cleaning fluid from the floor. The squeegee supporting means (48) includes first and second intermediate members (84, 98) and first, second, and third pivot means (68, 70, 72). The first pivot means (68) secures the first intermediate member (84) to the body (18) for swinging movement about a generally vertically extending axis (Z). The second pivot means (70) secures a forward portion of a downwardly and rearwardly extending arm (90) to the first intermediate member for swinging movement about a generally transversely extending axis (Y). The second intermediate member is secured to a rear portion of the arm, the securing means including an attitude adjusting member (102). The third pivot means (72) secures the squeegee assembly (46) to the second intermediate member (98) for rocking motion about a generally fore-and-aft extending axis (X), which axis is disposed well below the second pivot forming means (70). A lift cable (138) and a down pressure exerting means (124) are also associated with the improved support.

7 Claims, 4 Drawing Figures

Fig. 2.
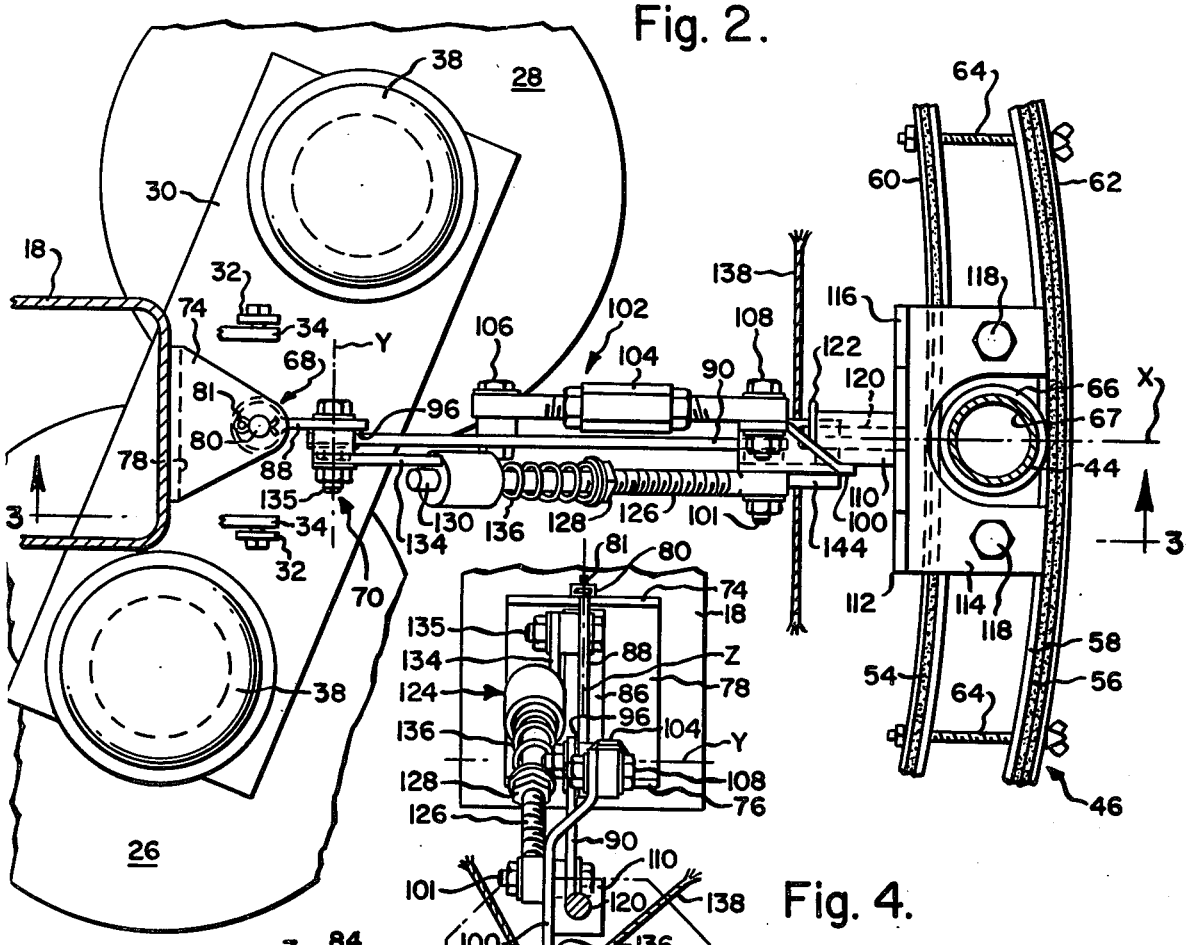
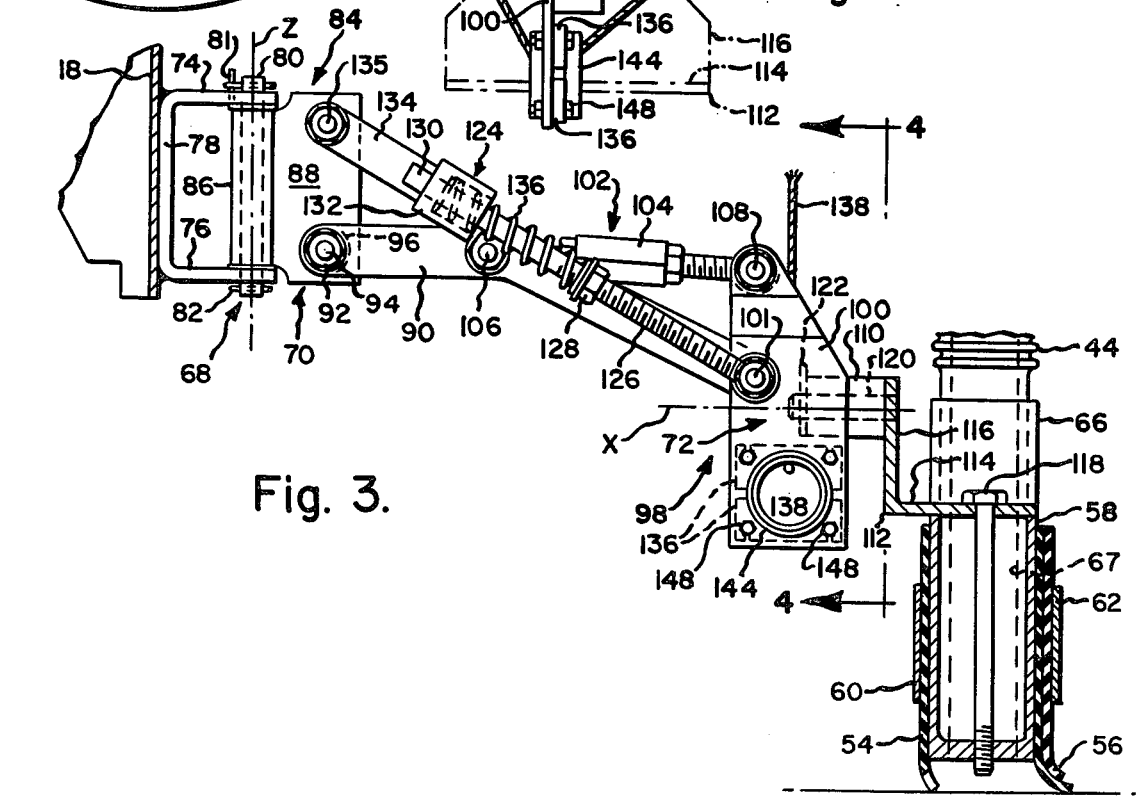
Fig. 3.
Fig. 4.

SUPPORT FOR A SQUEEGEE ASSEMBLY

FIELD OF THE INVENTION

The present invention relates generally to floor scrubbing machines of the type capable of dispensing a cleaning fluid onto the floor, scrubbing the floor with brushes, and subsequently removing the dirty fluid by a vacuum system including a squeegee assembly independently mounted behind the brushes. A machine of this general type is shown in copending U.S. patent application Ser. No. 186,420 filed Sept. 12, 1980. More specifically, the present invention relates to improved linkage for supporting the squeegee assembly behind the brushes to insure proper tracking of the squeegee assembly. The squeegee assembly includes a support or housing to which squeegees of resilient material are secure.

BACKGROUND OF THE INVENTION

In floor scrubbing machines of the type referred to above it is essential that the squeegee assembly properly track the brushes and conform to the surface of the floor in order to achieve satisfactory pickup of the cleaning fluid. For example, if the floor cleaning machine is to be turned it is necessary that the squeegee assembly swing independently of the machine in order to properly track the cleaned surface. Alternatively, if the machine is being advanced in a forward direction over a floor whose surface is not quite level, for example having high and low spots, it is necessary for the squeegee to conform to this surface. To this end, it is necessary that the squeegee assembly be able to tilt from side to side as well as to move up and down slight amounts in order to conform to the surface of the floor. In addition as the squeegees wear it is necessary that the squeegee assembly be able to move downwardly to keep the lower edge of the squeegees in contact with the floor surface. It is also necessary that the squeegee assembly be capable of upward movement to lift the squeegees from the floor as for example when transporting from a storage location to a working location, or when only scrubbing of the floor is desired.

Various designs for supporting the squeegee assembly have been proposed in the past, and one example is shown in copending U.S. application Ser. No. 186,420. Another design is shown in U.S. Pat. No. 4,339,841 issued July 20, 1982. While these designs have performed in a generally satisfactory manner it has been found that due to the crescent shape of the squeegee assembly utilized in these designs that it has been difficult to maintain the full length of the squeegee in contact with the floor surface with relatively instant down pressure under certain situations. For example, in both of the above designs relatively high forces are required to raise one side of the squeegee relative to the other, and it is desirable that the down force of the squeegee be maintained at a relatively constant level. In addition if both the forward wheels of the machine were to enter a low spot on the floor in the second of the two designs referred to above, the intermediate portion of the squeegee may actually lift off the surface of the floor to be cleaned. Other situations have been encountered where less than completely satisfactory performance has been achieved.

OBJECTS AND SUMMARY OF THE INVENTION

It is a principal object of this invention to provide an improved squeegee assembly mounting apparatus which overcomes the disadvantages of the known prior art. More specifically, it is an object of the present invention to provide an improved squeegee mounting apparatus which will permit the squeegee to conform in a more satisfactory manner to the surface of the floor.

Another object of the present invention is to provide an improved squeegee mounting apparatus which is of relatively durable construction and low cost.

These objects and other objects and advantages of this invention, which will be apparent to those having ordinary skill in the art, are achieved by providing an improved squeegee assembly mounting apparatus having independent vertical, transverse and fore-and-aft axes about which the squeegee can move, the fore-and-aft axis being disposed at a relatively low point. More specifically, the improved squeegee mounting apparatus includes a first intermediate member which is pivotally secured to the body of a floor cleaning machine for movement about a vertically extending axis. The forward end of a rearwardly and downwardly extending arm is secured to the first intermediate member for swinging movement of the arm about a generally transversely extending axis. The rear end of the arm carries a second intermediate member, and the squeegee assembly is secured to the second intermediate member by third pivot means which permits the squeegee to rock from side to side about a generally fore-and-aft extending axis. The foregoing will become more apparent from a consideration of the following detailed description taken in conjunction with the accompanying drawings which illustrate a preferred form of this invention.

BRIEF DESCRIPTION OF THE DRAWINGS

FIG. 2 is a fragmentary view taken generally along the line 2—2 in FIG. 1.

FIG. 3 is a view taken generally along the line 3—3 in FIG. 2.

FIG. 4 is a view taken generally along the line 4—4 in FIG. 3.

DETAILED DESCRIPTION OF THE PREFERRED EMBODIMENT

Figure 1:
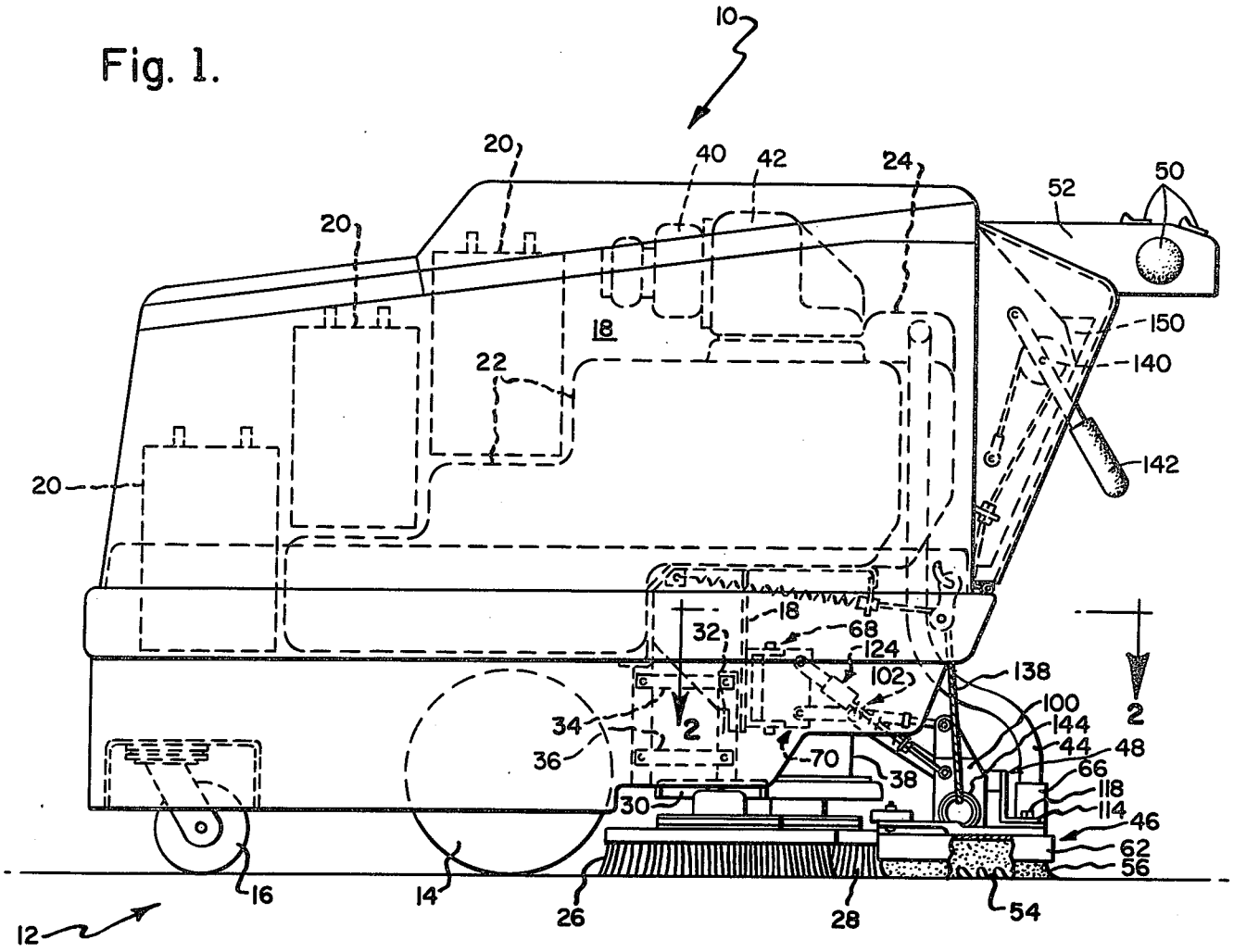
FIG. 1 is a side elevational view of the floor cleaning machine in which this invention is utilized, the floor cleaning machine including a body, propulsion means, floor scrubbing means, vacuum means including a squeegee assembly and a squeegee mounting apparatus, and various control means.

Referring to the drawings and more particularly to FIG. 1, the walk behind floor cleaning machine is generally indicated at 10, the machine being supported by propulsion means indicated generally at 12. The propulsion means include intermediate drive wheels 14 and front caster wheels 16. The propulsion means supports the body 18 which is divided into a forward stepped compartment and a rear compartment. Mounted within the forward stepped compartment are a plurality of batteries indicated at 20. Mounted in the rear compartment left and right tanks 22, 24 which carry, respectively, the cleaning fluid and the dirty fluid which is vacuumed from the floor. The machine additionally includes left and right brushes 26, 28, respectively, which are interconnected to a common support 30. The support in turn carries upstanding bracket means 32 which are pivotally secured to forwardly extending upper and lower parallel links 34, 36, which links are in turn pivotally secured at their forward end to the body 18 of the floor cleaning machine. The brushes 26, 28 are adapted to be rotated by motors 38, there being one motor for each of the brushes 26, 28. It should be appreciated from the above that the brushes 26 and 28 are mounted in cantilever fashion from the body 18 of the machine.

Associated with the right hand tank for the collection of dirty cleaning fluid are vacuum means which include a motor driven fan 40 associated with a plenum chamber 42, the plenum chamber being mounted on top of the tank 24. The vacuum means further includes a conduit 44, the upper end of which is connected to a portion of the tank 24, and the lower end of which is interconnected with the squeegee assembly indicated generally at 46. The squeegee assembly 46 is in turn supported in a cantilever manner by a squeegee mounting apparatus indicated generally at 48.

The machine described so far corresponds generally to that disclosed in copending U.S. patent application Ser. No. 186,420 filed Sept. 12, 1980 and reference can be made to said copending application for further details, the subject matter of said copending application which is common to this application being incorporated herein by reference thereto.

The floor cleaning means in addition is provided with control means for controlling the operation of the propulsion means, the brushes, and the vacuum means, which control means include various controls some of which are indicated at 50 on rearwardly extending control housing 52.

The squeegee means include front and rear vertically disposed squeegees 54, 56, respectively, which are spaced apart to provide a vacuum chamber, the squeegees being secured to a squeegee housing 58 by front and rear securing plates 60, 62, respectively and fasteners 64. The housing 58 is provided with an upstanding intermediate cylindrical section 66 to which the lower end of the conduit 44 is interconnected. To this end, it can be seen from FIG. 3 that the lower end of the conduit 44 is provided with a tubular extension which is loosely received in telescoping fashion within the cylindrical section 66. The housing 58 in general has a U-shaped cross sectional configuration, and it is also crescent shaped when viewed from above. The housing also has a through aperture 67 for connecting the vacuum chamber forward below the bottom wall of the U-shaped housing with the conduit 44. It should be noted that both the left and the right forward ends of the squeegees 54, 56 are disposed forward of their intermediate portions.

In accordance with the principles of this invention the squeegee assembly is supported by improved squeegee supporting means for movement about three axes indicated arbitrarily at X, Y, and Z, the axes being separated from each other by various structures. The X axis is a generally fore-and-aft extending axis, the Y axis is a generally transversely extending axis, and the Z axis is a generally vertically extending axis. These various axes are defined by first, second, and third pivot means indicated generally at 68, 70, and 72, the first pivot means 68 defining the Z axis, the second pivot means 70 defining the Y axis, and the third pivot means 72 defining the X axis.

The first pivot means 68 includes spaced apart upper and lower apertured arms 74, 76, respectively, the forward ends of these arms being interconnected by a vertically extending web portion 78, the arms 76, 78 and web portion 78 being secured to a portion of the body 18 by welding or the like. A pivot pin 80 passes through the apertures in the arms 74, 76. In practice the pivot pin is provided with a cotter pin or the like which rests upon the upper surface of the arm 74, there being another pin 81 which passes through the eye of the cotter pin 79 and an aperture in arm 74 to hold the pivot pin 80 from turning about its axis. The lower end of the pivot pin extends below the lower surface of the arm 76 and is provided with a transversely extending aperture which may receive a removable hairpin type fastener 82.

A first intermediate member, indicated generally at 84, is interconnected with the first pivot means and includes a vertically extending aperture defining means 86 which receives the pivot pin, and a rearwardly extending platelike portion 88, the platelike portion 88 having a vertical length approximately the same length as that of the pivot pin 80.

Generally rearwardly and downwardly extending arm means are provided, the arm means in this instance being in the form of a single arm 90. The forward end of the arm 90 is pivotally secured to a lower section of the platelike portion by the second pivot means 70, the second pivot means being in the form transversely extending nut and bolt 92, 94 provided with suitable washers and a bushing or spacer 96 disposed between one side of the platelike portion 88 and the nut 92, the apertured end of the arm 90 riding on the housing.

A second intermediate member, indicated generally at 98, is provided, the second intermediate member being adjustably secured to the arm 90. To this end, the second intermediate member is provided with a platelike element 100 whose forward intermediate portion is secured to the lower rearward end of the arm 90 by a suitable fastener assembly 101 consisting of a bolt, nut, washers, and bushings. In addition, the upper end of the platelike element 100 is secured to the arm 90 by an attitude adjusting mechanism indicated generally at 102. The attitude adjusting means 102 consisting essentially of an extensible and retractable link 104 in the form of a turnbuckle, the ends of which are secured at the forward end by fastener 106 and at the rearward end by fastener 108, the fasteners 106 and 108 being in the form of nuts and bolts.

The third pivot means includes a fore-and-aft extending aperture forming means 110, the aperture forming means being secured to the platelike element 100, location below the lower rearward end of the arm 90. The third pivot means also includes an angle plate 112 having a lower horizontal portion 114 and a vertically extending portion 116. The horizontal portion 114 is provided with a cutout for the reception of the cylindrical section 66, and to either side of the cutout it is also provided with small apertures for the reception of cap screws 118 which secure the angle plate to the bottom of the squeegee housing. The rear end of a fore-and-aft extending pivot pin 120 is secured to an upper intermediate portion of the vertical plate 116, the pivot pin 120 in turn passing through the fore-and-aft extending aperture forming means 110. The forward end of the pivot pin 120 is provided with an aperture which extends perpendicularly to the axis X of the pin, and a hairpin 122 is received within the aperture. As should be obvious the hairpin can be removed readily by the operator of the floor cleaning machine to permit easy disassembly of the squeegee assembly. In addition, it should also be noted that the lower end of the conduit 44 can be easily removed from within the cylindrical section 66.

By providing the foregoing structure the squeegee assembly can readily track the brushes during the operation of the floor cleaning machine to provide for satisfactory removal of the dirty cleaning fluid. By keeping the fore-and-aft extending axis X at a relatively low point the crescent shaped squeegee assembly can better rock from side to side as uneven portions of the floor are encountered. In addition, it should be noted that by having the vertical axis Z disposed in the manner illustrated in FIG. 2 where it passes through the mid-portion of the plane defined by the axes of rotation of the brushes 26 and 28 better tracking during turning of the machine is achieved.

When the squeegee assembly is in its lower operative position illustrated in FIG. 3 its down pressure can be adjusted by down pressure exerting means indicated generally at 124. The down pressure exerting means is a lost motion or telescoping link assembly spring biased to an extended position. The link assembly includes a threaded element 126 one end of which is apertured for the reception of fastener assembly 101. As can be seen, the rear end of the link assembly is secured to one side of the platelike element 100, while the rear end of the arm is secured to the other side of element 100. A mid-portion of the threaded element receives an adjusting nut 128, and the end 130 of the link remote from the aperture passes through a stepped tubular element 132. The element 132 is carried by one end of another link 134 whose other end is pivotally secured to the platelike portion 88 by a fastener assembly 135. A spring 136 encompasses the element 126 and extends between the adjusting nut 128 and the step within the stepped tubular element 132 to normally spring bias the parts away from each other. The down pressure can be adjusted by adjusting the position of the nut 128.

Finally, it should be noted that means are provided for raising the squeegee assembly from its lowered operative position illustrated in FIG. 3 to a raised inoperative position. This is accomplished by a cable lift assembly of the type illustrated in U.S. Pat. No. 4,339,481 and includes a cable 138 whose ends are relatively fixed with respect to the body 18 of the machine, an intermediate portion of the cable passing over sheave 140 carried by pivoted handle assembly 142 and another intermediate portion passing through a ceramic grommet 144. The ceramic grommet in turn extends through an aperture in the lower portion of the platelike element 100 and is being held in place by retainers 146 and fasteners 148. When the handle 142 is moved from its lowered position illustrated in FIG. 1 to a raised position it should be appreciated that the squeegee assembly will also be raised. Handle 142 is locked in an upward position by catching it on a ramp web 150, and is lowered by exerting side force on handle 142.

Although a preferred embodiment of the present invention has been disclosed and described, changes will obviously occur to those skilled in the art. It is therefore intended that the present invention is to be limited only by the scope of the following claims.

What is claimed is:

1. In a floor cleaning machine of the type having a body supported by front and intermediate wheels for movement in a forward direction, brush means, brush supporting means interconnecting said brush means and said body means and being capable of supporting the brush means in cantilever fashion to the rear of said intermediate wheels, a squeegee assembly, and improved squeegee assembly supporting means interconnecting said squeegee means and said body means and capable of supporting the squeegee means in cantilever fashion to the rear of said brush means, said improved squeegee supporting means comprising a first intermediate member, first pivot means interconnecting said first intermediate member to said body for swinging movement from side to side about a generally vertically extending axis, arm means which extend in its normal working position in a generally rearwardly and downwardly direction, second pivot means interconnecting a forward end portion of said arm means to said first intermediate member for swinging from a lowered working position to a raised inoperative position about a generally transversely extending axis, a second intermediate member secured to a rearward end portion of said arm for movement therewith, third pivot means interconnecting a mid-portion of the squeegee assembly to said second intermediate member for rocking movement about a generally fore-and-aft extending axis, and additionally characterized by said second intermediate member being provided with transversely extending aperture forming means below said fore-and-aft extending axis, and in which said machine is further characterized by the provision of lifting means, said lifting means including an intermediate cable portion which passes through said transversely extending aperture forming means.

2. In a floor cleaning machine of the type having a body supported by front and intermediate wheels for movement in a forward direction, brush means, brush supporting means interconnecting said brush means and said body means and being capable of supporting the brush means in cantilever fashion to the rear of said intermediate wheels, a squeegee assembly, and improved squeegee assembly supporting means interconnecting said squeegee means and said body means and capable of supporting the squeegee means in cantilever fashion to the rear of said brush means, said improved squeegee supporting means comprising a first intermediate member, first pivot means interconnecting said first intermediate member to said body for swinging movement from side to side about a generally vertically extending axis, arm means which extend in its normal working position in a generally rearwardly and downwardly direction, second pivot means interconnecting a forward end portion of said arm means to said first intermediate member for swinging from a lowered working position to a raised inoperative position about a generally transversely extending axis, a second intermediate member secured to a rearward end portion of said arm for movement therewith, third pivot means interconnecting a mid-portion of the squeegee assembly to said second intermediate member for rocking movement about a generally fore-and-aft extending axis, and down pressure exerting means, said down pressure exerting means including a fore-and-aft extending, lost motion link normally spring biased to an extended position, the forward end of the lost motion link being secured to said first intermediate member for swinging movement about a transversely extending axis at a point above said first pivot means, and said rearward end of the lost motion link being secured to the second intermediate member for movement about a transversely extending axis.

3. In a floor cleaning machine of the type having a body supported by front and intermediate wheels for movement in a forward direction, brush means, brush supporting means interconnecting said brush means and said body means and being capable of supporting the brush means in cantilever fashion to the rear of said intermediate wheels, a squeegee assembly, and improved squeegee assembly supporting means interconnecting said squeegee means and said body means and capable of supporting the squeegee means in cantilever fashion to the rear of said brush means, said improved squeegee supporting means comprising a first intermediate member, first pivot means interconnecting said first intermediate member to said body for swinging movement from side to side about a generally vertically extending axis, arm means which extend in its normal working position in a generally rearwardly and downwardly direction, second pivot means interconnecting a forward end portion of said arm means to said first intermediate member for swinging from a lowered working position to a raised inoperative position about a generally transversely extending axis, a second intermediate member secured to a rearward end portion of said arm for movement therewith, third pivot means interconnecting a mid-portion of the squeegee assembly to said second intermediate member for rocking movement about a generally fore-and-aft extending axis, and attitude adjusting means including an extensible and retractable link, and bolt assemblies securing said link at its front and rear ends to an intermediate portion of said arm, and to an upper portion of its second intermediate member, respectively.

4. An improved squeegee supporting means of the type capable of supporting a crescent shaped squeegee assembly on the body of a floor cleaning machine, said improved squeegee supporting means comprising:

a first intermediate member provided with a vertically extending aperture and a rearwardly extending portion parallel to said aperture;

first pivot means for securing the first intermediate member to the body of said floor cleaning machine, the first pivot means including spaced apart upper and lower apertured arms secured to said body, and first pivot pin means extending through the vertically extending aperture of the first intermediate member and the apertured arms to hold the first intermediate member for swinging movement about a generally vertically extending axis;

rearwardly and downwardly extending arm means, said arm means being provided with a forward transversely extending aperture;

second pivot means including a pivot pin passing through the forward transversely extending aperture of the arm means and a corresponding aperture in the rearwardly extending portion of the first intermediate member to pivotally secure the arm means for movement about a generally transversely extending axis;

a second intermediate member secured to a rearward portion of the arm means; and third pivot means interconnecting the second intermediate member with the crescent shaped squeegee assembly for rocking movement about a generally fore-and-aft extending axis, said third pivot means including a longitudinally extending pivot pin secured at one end to the squeegee assembly and an element having a longitudinally extending aperture which receives said pivot pin, said element being secured to said second intermediate member.

5. An improved squeegee supporting means as set forth in claim 4, further characterized by the provision of means capable of exerting down pressure on the squeegee assembly, said down pressure exerting means including a lost motion link spring biased to an extended position, one end of the lost motion link being secured to the first intermediate member at a location above the second pivot means, and the other end of the lost motion link being secured to the second intermediate member adjacent said rearward portion of the arm means.

6. An improved squeegee supporting means as set forth in claim 4 further characterized by the provision of attitude adjusting means extending between an intermediate portion of said arm means and an upper end of the second intermediate member, said attitude adjusting means including a turnbuckle assembly, one end being secured to said intermediate portion of the arm means and the other end being secured to the second intermediate member at a location spaced above the rearward end portion of said arm means.

7. An improved squeegee supporting means as set forth in claim 6 further characterized by the provision of down pressure exerting means, said down pressure exerting means including a generally fore-and-aft extending lost motion link spring biased to an extended position, the forward end of the lost motion link being secured to said first intermediate member at a location spaced above said second pivot means, and the rear end of said lost motion link being secured adjacent the rear end of said arm means.

* * * * *